US006250496B1

(12) United States Patent
Mazzetti

(10) Patent No.: US 6,250,496 B1
(45) Date of Patent: Jun. 26, 2001

(54) SECURITY CLOSING DEVICE FOR A CONTAINER HAVING A LID

(75) Inventor: Claudio Mazzetti, Modena (IT)

(73) Assignee: Swisslog Italia S.p.A., Milan (IT)

( * ) Notice: Subject to any disclaimer, the term of this patent is extended or adjusted under 35 U.S.C. 154(b) by 0 days.

(21) Appl. No.: 09/429,618

(22) Filed: Oct. 29, 1999

(30) Foreign Application Priority Data

Dec. 30, 1998 (EP) ..... 98830803

(51) Int. Cl.[7] ..... A47F 1/04
(52) U.S. Cl. ..... 221/154; 221/287
(58) Field of Search ..... 221/154, 208, 221/247, 248, 282, 287, 98, 197; 220/211, 345.1, 348

(56) References Cited

U.S. PATENT DOCUMENTS 3,102,662 * 9/1963 Crabtree ..... 221/154
3,973,687 8/1976 Glick .
5,752,620 5/1998 Pearson .

FOREIGN PATENT DOCUMENTS 472262 2/1929 (DE) .
4126130 2/1993 (DE) .
2675471 10/1992 (FR) .

* cited by examiner

*Primary Examiner*—Kenneth W. Noland
(74) *Attorney, Agent, or Firm*—Browdy & Neimark

(57) ABSTRACT

The security device for containers having lids comprises a catch which is mobile internally of a chamber associated to the container and which has an end which is predisposed to insert snugly and be removed from a hollow seating afforded in a lid. The catch is mobile internally of the chamber in a non-parallel direction to an uncoupling direction of the lid from a retracted position, at which it does not interfere with the hollow seating, and at least one extended position, in which it is at least partially inserted in the hollow seating. The movement of the catch is pneumatically actuated.

8 Claims, 1 Drawing Sheet

SECURITY CLOSING DEVICE FOR A CONTAINER HAVING A LID

BACKGROUND OF THE INVENTION

In particular, though not exclusively, the invention is usefully applied for pharmaceutical containers for dispensing pills, capsules and the like which are destined to be used in automatised container dispensers installed in hospitals. One of the main problems encountered in these dispensers concerns how to make the numerous types of containers simple and rapid to obtain for authorised personnel only, whether the containers are empty (i.e. to be filled) or already full.

The prior art does not teach any solution to this problem which combines sufficient security against abuse by non-authorised persons with a satisfactory simplicity not only with regard to construction, but also and especially concerning the simplicity or practicalness of use by authorised personnel.

SUMMARY OF THE INVENTION

The main aim of the present invention is to overcome the above-mentioned lacks in the prior art by providing a security closure for lidded containers which is constructionally simple and easy to use.

An advantage of the present invention consists in its easy applicability to containers already in use.

These aims and advantages and more besides are all attained by the present invention, as it is characterised in the appended claims.

BRIEF DESCRIPTION OF THE DRAWINGS

Further characteristics and advantages of the present invention will better emerge from the detailed description that follows of a preferred but non-exclusive embodiment of the invention, illustrated purely by way of a non-limiting example in the accompanying figures of the drawings, in which.

DESCRIPTION OF THE PREFERRED EMBODIMENTS

Figure 1:
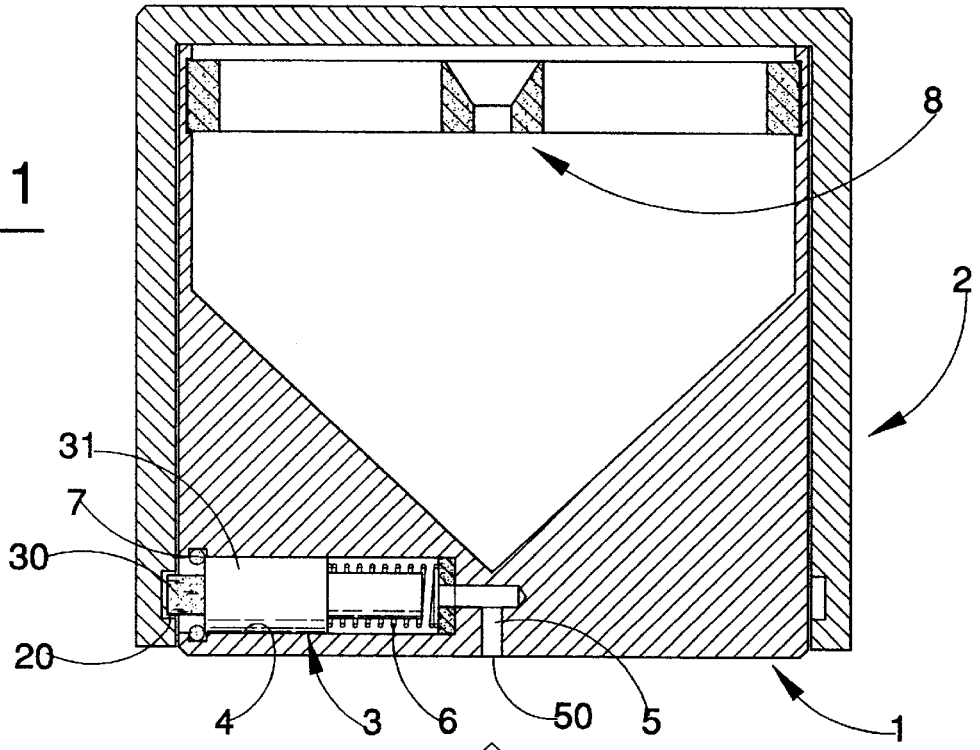
FIG. 1 shows the invention applied on a container shown in a schematic section made according to a median vertical plane of the container itself.

With reference to the figures, 1 denotes in its entirety a container, used for containing medical substances in the form of pills, capsules or the like. The container 1 is closed by a lid 2. To open the container 1 the lid 2 is uncoupled by a simple axial displacement. By repeating the axial movement in the opposite direction the container 1 can be re-closed.

The security closure of the container 1 is achieved by blocking the lid 2 on the container 1 by means of a security closing device which comprises a catchtype device, denoted by 3 in the figure. The catch 3 is mobile within a chamber 4 associated to the container 1 and is provided with an end 30 which is predisposed to insert (and be removed) exactly in (or from) a hollow seating 20 made in the lid 2.

Figure 2:
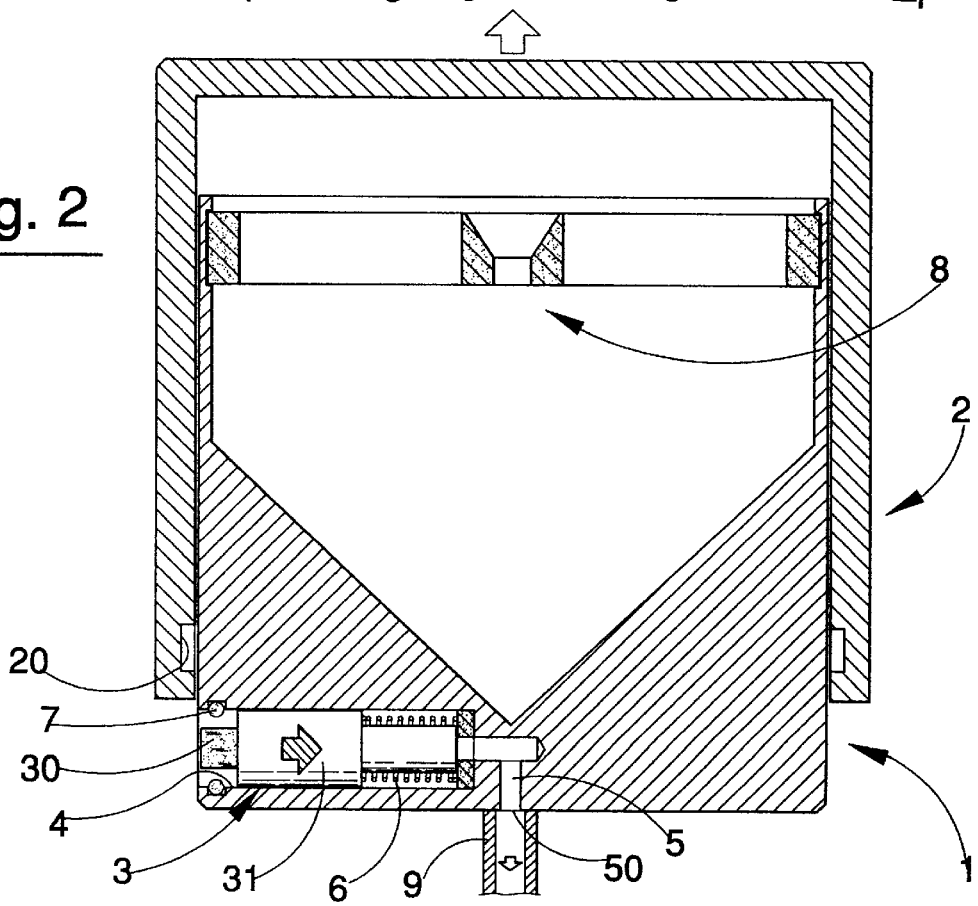
FIG. 2 shows the same section as in FIG. 1, in a different operative configuration.

The catch 3 is mobile inside the chamber 4 in a direction which is not parallel to the uncoupling direction of the lid 2, from a retracted position as shown in FIG. 2, where it does not interfere with the hollow seating 20, to at least one external position, visible in FIG. 1, where it is at least partially inserted internally of the hollow seating 20.

In particular, the chamber 4 housing the catch 3 is located in proximity of the bottom of the container 1 and is oriented in such a way that the catch 3 is axially mobile in a direction which is perpendicular to the external lateral surface of the container 1 from which the end 30 can project externalwise. In the illustrated example the catch 3 comprises a central body 31 which is exactly housed internally of the chamber 4 and which functions as a piston. The central body 31 divides the chamber 4 into two parts: one open part which opens at the lateral wall (vertical) of the container 1, in which the end 30 is housed and is mobile; and one closed part, which communicates with the outside by means of a conduit 5 which opens at an aperture 50 situated on the external surface of the bottom of the container 1.

More precisely, the aperture 50 is located at the centre of the bottom of the container 1.

In the closed part of the chamber 4, a spring 6 is housed coaxially to the catch 3, which spring 6 has the function of pushing the catch 3 externalwise with a predetermined force.

A limiter 7 is located in the part of the chamber 4 which is open externalwise, and has the function of interacting with the central body 31 to stop the catch 3 and limit the maximum run of the end 30 with respect to the lateral surface of the container 1.

The described device maintains the lid 2 solidly constrained to the container 1 when the end 30 of the catch 3 is inserted in the hollow seating 20 made in the lid 2. The spring 6, by pushing the central body 31 against the limiter 7, keeps the end 30 stably inserted in the hollow seating 20.

The container 1 can be opened only when the end 30 is completely disengaged from the hollow seating 20. This is possible only by retracting the catch 3 from the position illustrated in FIG. 1 into that of FIG. 2.

The catch 3 can be retracted by causing a depression in the conduit 5 and consequently in the part of the chamber 4 containing the spring 6.

Lowering the pressure in the conduit 5 can be done easily by applying a suction tube 9 (connected to a suitable aspiration plant) to the aperture 50, and sucking out the air contained in the inside of the part of the chamber 4 in which the spring 6 is situated.

When the pressure is sufficiently depressed, the central body 31, functioning as a piston, overcomes the force of the spring 6 and retracts, disengaging the end 30 from the hollow seating 20 and freeing the lid 2, which becomes removable.

The illustrated closing device can be used on containers such as the one illustrated, which exhibits an upturned-cone-shaped bottom and a coaxial guide 8 for guiding an end of a tube (not illustrated) introduced from above and inserted down to the level of the point of the cone. This configuration enables all the pills in the container 1 to be removed one-by-one, and facilitates removal of the last remaining pills in the container 1.

In a further embodiment, not illustrated, the internal bottom side of the container 1 could be upturned-pyramid-shaped instead of cone-shaped.

The closing device illustrated is constructionally simple, offers sufficient guarantees of security and is easily applicable to normally used container types.

What is claimed is:

1. A security closing device for a container having a lid, comprising a catch which is mobile internally of a chamber associated to the container and having an end which is predisposed to insert snugly into and be removed from a hollow seating afforded in the lid; said catch being mobile internally of said chamber in a non-parallel direction to an uncoupling direction of the lid; said catch being movable from a retracted position, in which there is no interference with said hollow seating, and at least one extended position, in which the catch is at least partially inserted internally of said hollow seating; an actuation of said catch from said at least one extended position being achieved by pneumatic means.

2. The device of claim 1, wherein said catch comprises a central body which is housed snugly internally of the chamber and which acts as a piston; the central body of the catch dividing the chamber into two parts, of which one part is open and houses said end, and of which one part is closed and is in communication with the outside environment by means of a conduit which has an aperture situated on an external surface of the container.

3. The device of claim 2, wherein the aperture is located on the external surface of the container which constitutes a bottom of the container.

4. The device of claim 3, wherein a spring is housed in the closed part of the chamber, which spring is coaxial to the catch, and which spring pushes the catch in an extemalwise direction with respect to the lateral wall of the container; a limiter being provided to limit a maximum externalwise extension of the end.

5. The device of claim 4, wherein said chamber housing said catch is located in proximity of the bottom of the container; the catch being axially mobile in a perpendicular direction to a lateral external surface of the container; the catch being able to project externally of the container.

6. The device of claim 5, wherein the aperture is located at a centre of the bottom of the container.

7. The device of claim 6, wherein an internal surface of the bottom of the container has an upturned-cone-shape; a guide being provided which is coaxial to a point of said cone-shaped internal surface of the bottom of the container and which guides an end of a tube introduced from above into the container to said point of the cone-shaped internal surface.

8. The device of claim 7, wherein the internal surface of the bottom of the container is upturned-pyramid shaped; a guide being provided which is coaxial to a point of said pyramid-shaped internal surface of the bottom of the container and which guides an end of a tube introduced from above into the container to said point of the pyramid-shaped internal surface.

* * * * *